US009486712B2

(12) United States Patent
Hsu et al.

(10) Patent No.: US 9,486,712 B2
(45) Date of Patent: Nov. 8, 2016

(54) MOTION SENSING REMOTE CONTROL DEVICE

(71) Applicants: Hung-Wang Hsu, Taoyuan County (TW); Chun-Hsiang Yang, Taoyuan County (TW)

(72) Inventors: Hung-Wang Hsu, Taoyuan County (TW); Chun-Hsiang Yang, Taoyuan County (TW)

( * ) Notice: Subject to any disclaimer, the term of this patent is extended or adjusted under 35 U.S.C. 154(b) by 144 days.

(21) Appl. No.: 14/454,753

(22) Filed: Aug. 8, 2014

(65) Prior Publication Data

US 2015/0057841 A1 Feb. 26, 2015

(30) Foreign Application Priority Data

Aug. 23, 2013 (TW) ..... 102130343 A

(51) Int. Cl.
*A63H 17/36* (2006.01)
*A63H 30/04* (2006.01)

(52) U.S. Cl.
CPC ..... *A63H 17/36* (2013.01); *A63H 30/04* (2013.01)

(58) Field of Classification Search
CPC ..... A63H 17/36; A63H 30/04
USPC ..... 341/176; 446/FOR. 000
See application file for complete search history.

(56) References Cited

U.S. PATENT DOCUMENTS

| | | | | |
|---|---|---|---|---|
| 4,929,949 | A * | 5/1990 | Yamamoto | A63H 30/00 244/190 |
| 5,945,936 | A * | 8/1999 | Issa | B60R 25/1004 340/12.23 |
| 6,265,987 | B1 * | 7/2001 | Wang | G08C 19/28 340/12.28 |
| 6,509,848 | B1 * | 1/2003 | Ogata | G08C 23/04 200/515 |
| 6,703,941 | B1 * | 3/2004 | Blaker | G08C 17/02 340/12.28 |
| 7,116,229 | B1 * | 10/2006 | Miramontes | H04B 1/202 340/10.51 |
| 2008/0174467 | A1 * | 7/2008 | Drimusz | G08C 19/28 341/176 |
| 2013/0109272 | A1 * | 5/2013 | Rindlisbacher | A63H 30/04 446/454 |
| 2014/0008496 | A1 * | 1/2014 | Ye | B64C 13/20 244/190 |

* cited by examiner

*Primary Examiner* — John Q Nguyen
*Assistant Examiner* — Jordan S Fei
(74) *Attorney, Agent, or Firm* — Lin & Associates Intellectual Property, Inc.

(57) ABSTRACT

A motion sensing remote control device including a motion sensing module, a calculation unit, a motion setting unit, a transmit unit and a receiving unit is disclosed. The present invention controls a remote control car to perform various motions by sensing the user's gestures. The motion sensing module senses and converts the gestures into a voltage signal for the calculation unit to perform calculation. The motion setting unit generates a corresponding command based on the calculation result of the calculation unit, and transmits the command to the remote control car through the transmit unit and the receiving unit such that the remote control car executes the received command to perform the corresponding motion specified by the user.

7 Claims, 2 Drawing Sheets

MOTION SENSING REMOTE CONTROL DEVICE

CROSS-REFERENCES TO RELATED APPLICATION

This application claims the priority of Taiwanese Patent Application No. 102130343, filed on Aug. 23, 2013, which are incorporated herewith by reference.

BACKGROUND OF THE INVENTION

1. Field of the Invention

The present invention generally relates to a remote control device, and more specifically to a motion sensing remote control device for easily controlling a remote control car to perform corresponding motions through a user's intuitive sense.

2. The Prior Arts

Among various interactive model toys, a remote control car is believed to be one of the most popular for adults and kids. The remote control car is generally remotely controlled by manipulating the joystick (or bar) or the keys provided on the remote controller to cause the remote control car to perform corresponding motions such as moving forward or backward, or turning around.

In the prior arts, the control system for controlling the remote control car is usually implemented by different designs such as frequency modulation (FM) or amplitude modulation (AM). The remote control car basically comprises a car body, a signal receiving unit and a drive part. The signal receiving unit and the drive part are installed in the car body, and the signal receiving unit is electrically connected to the drive part. When the user sends an operation signal, the signal receiving unit receives and converts the operation signal into an operation command, which is then transferred to the drive part so as to drive the car body to move.

However, the control direction of the current remote control car is oriented by the head of the remote control car. As a result, it often happens that the proceeding direction of the remote control car is opposite to the direction in which the joystick or bar is pulled by the user during remote control. This problem may cause the remote control car to bump into or get stuck in the obstacle on the way, or even suffer from serious damage.

In addition, the joystick and the keys lack good sensitivity. The corresponding hardware is firstly actuated to trigger the operation signal, which is transferred to the drive part to move the remote control car, and the user needs to correctly pull or move the joystick or press the keys to generate the operation signal. As a result, it takes some time for the hardware to operate and process the signal such that the remote control car often fails to move or stop immediately. Also, the remote control car easily overturns, collides with or gets stuck in the obstacle.

The traditional gun-like or joystick controller is provided with an actuation control mechanism for respectively controlling the turning motion and the throttle bar of the remote control car. As for the joystick controller, the throttle bar can be manipulated to move upward and downward and the turning throttle bar in the rightwise and leftwise directions so as to cause the remote control car to move forward, backward, stopping, turning and running around. However, it fails to perform some specific motions like acceleration or deceleration. As with the above problem of not meeting the real time operation, the remote control solution in the prior arts only provides the user to handle the proceeding direction of the remote control car by pulling the control bar with the fingers in an indirect sense. Such an operation is boring and lacks the variety, and further, the user can not easily control the remote control car to perform correct motion from a direct and intuitive sense.

Therefore, the present design only simulates few proceeding motions for a real car, leading to limited functions and applications, and hence the user may easily lose the sense of achievement and the interest in playing the remote control car in a short period of time.

SUMMARY OF THE INVENTION

The primary object of the present invention is to provide a motion sensing remote control device, which helps the user intuitively control the remote control car to perform corresponding motions through specific gestures, thereby enhancing the preciseness of control and improving the user's interest and sense of achievement.

To this end, the motion sensing remote control device of the present invention comprises a motion sensing module, a calculation unit, a motion setting unit, a transmit unit and a receiving unit. Specifically, the motion sensing module is provided on the motion sensing remote control device for sensing a respective physical variation of an angular velocity in X-axis and/or Y-axis. The physical variation is converted into an analog voltage signal for the respective angular velocity in X-axis and/or Y-axis, and the analog voltage signal is then transmitted.

The calculation unit is provided on the motion sensing remote control device and connected to the motion sensing module for receiving the analog voltage signal for the angular velocity in X-axis and/or Y-axis from the motion sensing remote control device. Further, the calculation unit calculates a variation of the analog voltage signal for the angular velocity in X-axis and/or Y-axis through a motion prediction algorithm, and encodes the variation into a first motion message and/or a second motion message. For example, the first motion message comprises a message for turning rightwise, leftwise or backing, and the second motion message comprises a message for forward or backward moving or stopping movement. The calculation unit then converts the analog voltage signal for the angular velocity in X-axis and/or Y-axis into an X-axis pulsed width modulation signal and/or a Y-axis pulsed width modulation signal, calculates a periodical variation for the X-axis pulsed width modulation signal and/or the Y-axis pulsed width modulation signal through the motion prediction algorithm, and encodes a third motion message and/or a fourth motion message based on the periodical variation for the X-axis pulsed width modulation signal and/or the Y-axis pulsed width modulation signal. Preferably, the third motion message comprises a message for increasing, fixing or reducing a turning scale, and the fourth motion message comprises a message for accelerating, fixing or decelerating movement.

The motion setting unit is provided on the motion sensing remote control device and connected to the calculation unit for receiving the first, second, third and fourth motion messages from the calculation unit. The first, second, third and fourth motion messages are decoded into first, second, third and fourth motion control commands, respectively, which are further transmitted. It is preferred that the motion setting unit comprises a built-in programmable and rewritable motion setting database including the first, second, third and fourth motion control commands corresponding to the first, second, third and fourth motion messages, respectively.

The transmit unit is provided on the motion sensing remote control device and connected to the motion setting unit for receiving the first, second, third and/or fourth motion control commands from the motion setting unit, and wirelessly transmitting the first, second, third and/or fourth motion control commands. The receiving unit is provided in the remote control car for receiving the first, second, third and/or fourth motion control commands from the transmit unit. The remote control car steers its proceeding direction based on the first and second motion control commands, and changes its turning scale and proceeding speed based on the third and fourth motion control commands.

More specifically, the first motion message is a message for turning rightwise, leftwise or backing based on the variation of the analog voltage signal for the angular velocity in X-axis, the second motion message is a message for forward or backward moving, or stopping movement based on the variation of the analog voltage signal for the angular velocity in Y-axis, the third motion message is a message for increasing, fixing or reducing the turning scale based on the periodical variation of the analog voltage signal for the angular velocity in X-axis, and the fourth motion message is a message for accelerating, fixing or decelerating movement based on the periodical variation of the analog voltage signal for the angular velocity in Y-axis.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENT

The present invention may be embodied in various forms and the details of the preferred embodiments of the present invention will be described in the subsequent content with reference to the accompanying drawings. The drawings (not to scale) show and depict only the preferred embodiments of the invention and shall not be considered as limitations to the scope of the present invention. Modifications of the shape of the present invention shall too be considered to be within the spirit of the present invention.

Figure 1:
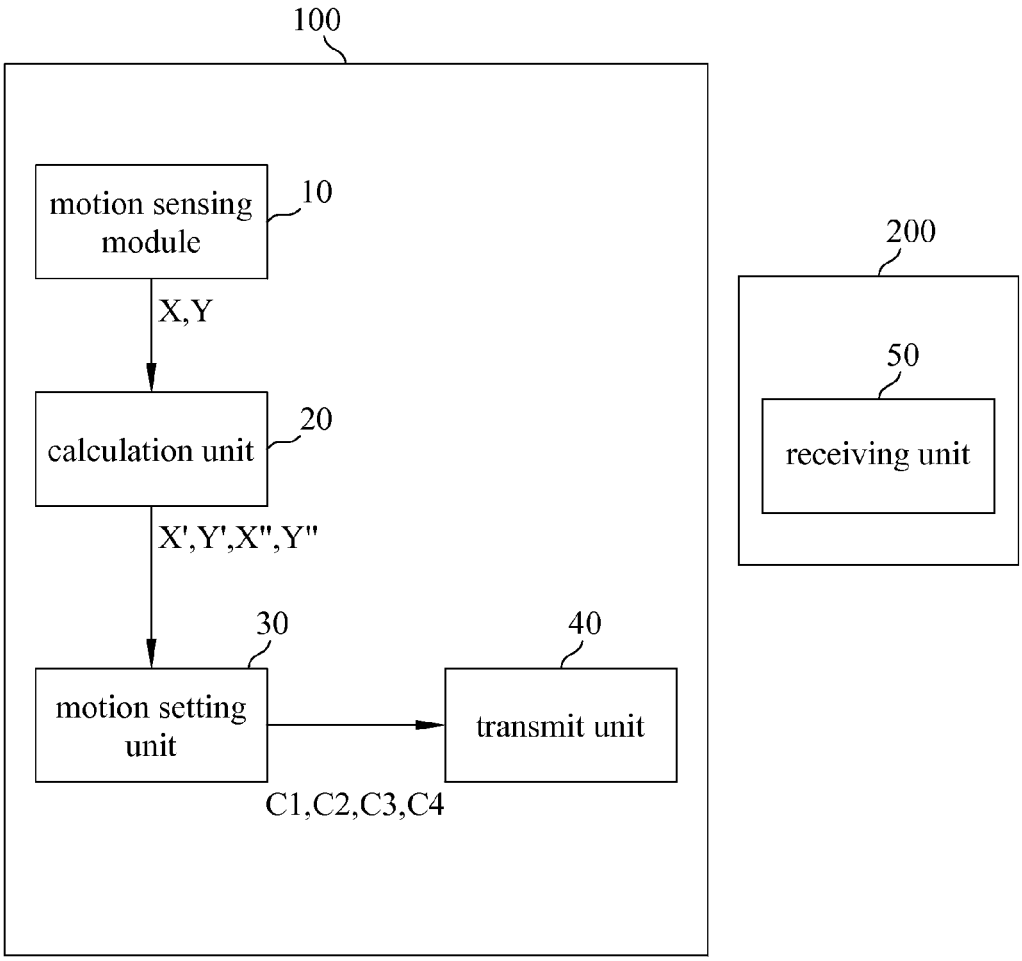
FIG. 1 is a functional block diagram of the motion sensing remote control device according to a first embodiment of the present invention.

Please refer to FIG. 1, illustrating a functional block diagram of the motion sensing remote control device according to the first embodiment of the present invention. As shown in FIG. 1, the motion sensing remote control device 100 is used for controlling a remote control car 200, and comprises a motion sensing module 10, a calculation unit 20, a motion setting unit 30, a transmit unit 40 and a receiving unit 50.

Specifically, the motion sensing module 10, the calculation unit 20, the motion setting unit 30 and the transmit unit 40 are provided on the motion sensing remote control device 100, while the receiving unit 50 is provided in the remote control car 200.

The motion sensing module 10 senses a respective physical variation of an angular velocity in X-axis and/or Y-axis for the motion sensing remote control device 100. The physical variation is converted into an analog voltage signal X for the angular velocity in X-axis and/or an analog voltage signal Y for the angular velocity in Y-axis, and the analog voltage signals X and Y are then transmitted.

Preferably, the motion sensing module 10 at least comprises an angular displacement sensor and a signal conversion circuit (not shown). The angular displacement sensor senses a physical variation for the angular velocity in X-axis and/or Y-axis of the motion sensing remote control device 100, and the signal conversion circuit converts the physical variation for the angular velocity in X-axis and/or Y-axis into the analog voltage signals X and Y, which are transmitted.

The above angular displacement sensor is preferably implemented by an MEMS gyroscope, electronic compass, angular velocity meter, or other devices for sensing the horizontal change of an object.

The calculation unit 20 is connected to the motion sensing module 10 for receiving the analog voltage signals X and Y from the motion sensing remote control device 10. Further, the calculation unit 20 previously stores a specific motion prediction algorithm used to calculate a variation of the analog voltage signals X and through, and encodes the variation into a first motion message X' and/or a second motion message Y'. Here, the first motion message X' comprises a message for turning rightwise, leftwise or backing, and the second motion message Y' comprises a message for forward or backward moving or stopping movement. The calculation unit 20 converts the analog voltage signals X and Y into an X-axis pulsed width modulation signal and/or a Y-axis pulsed width modulation signal, calculates a periodical variation for the X-axis pulsed width modulation signal and/or the Y-axis pulsed width modulation signal through the motion prediction algorithm, and encodes a third motion message X" and/or a fourth motion message Y" based on the periodical variation for the X-axis pulsed width modulation signal and/or the Y-axis pulsed width modulation signal. It is preferred that the third motion message X" comprises a message for increasing, fixing or reducing a turning scale, and the fourth motion message Y" comprises a message for accelerating, fixing or decelerating movement.

The motion setting unit 30 is connected to the calculation unit 20 for receiving the first motion message X', the second motion message Y', the third motion message X" and the fourth motion message Y" from the calculation unit 20. The first motion message X', the second motion message Y', the third motion message X" and the fourth motion message Y" are decoded into the first control command C1, the second control command C2, the third control command C3 and the fourth motion control command C4, respectively, which are further transmitted. More specifically, the motion setting unit 30 comprises a built-in programmable and rewritable motion setting database, which includes the first control command C1, the second control command C2, the third control command C3 and the fourth motion control command C4 corresponding to the first motion message X', the second motion message Y', the third motion message X" and the fourth motion message Y", respectively.

The transmit unit 40 is connected to the motion setting unit 30 for receiving the first control command C1, the second control command C2, the third control command C3 and the fourth motion control command C4 from the motion setting unit 30, which are wireless transmitted.

The receiving unit 50 receives the first control command C1, the second control command C2, the third control command C3 and the fourth motion control command C4 such that the remote control car 200 steers its proceeding direction based on the first control command C1 and the second control command C2. That is, the remote control car 200 is controlled to perform the forward moving, backward moving, stopping, turning, running around, S turning and so on. Additionally, the remote control car 200 changes its turning scale and or proceeding speed according to the third control command C3 and or the fourth motion control command C4, thereby controlling the remote control car 200 to accelerate or decelerate, as well as its turning scale.

The receiving unit 50 may comprise a control chip (not shown) connected to a motor driving device and a turning system (not shown). Specifically, the control chip is used to control the motor driving device to operate and the turning system to make a turn according to the first control command C1, the second control command C2, the third control command C3 and the fourth motion control command C4.

In one embodiment of the present invention, the transmit unit 40 comprises a radio frequency transmit circuit (not shown), and the receiving unit 50 comprises a radio frequency receive circuit (not shown).

More specifically, the first motion message X' is a message for turning rightwise, leftwise or backing, depending on the variation of the analog voltage signal X for the angular velocity in X-axis, the second motion message Y' is a message for forward or backward moving, or stopping movement, depending on the variation of the analog voltage signal Y for the angular velocity in Y-axis, the third motion message X" is a message for increasing, fixing or reducing the turning scale, depending on the periodical variation for the X-axis pulsed width modulation signal, and the fourth motion message Y" is a message for accelerating, fixing or decelerating movement, depending on the periodical variation for the Y-axis pulsed width modulation signal.

From the above-mentioned, one aspect of the present embodiment is that the user can control the remote control car 200 to proceed to leftwise or rightwise by just adjusting the X-axis horizontal position of the motion sensing remote control device 100, or alternatively, the remote control car 200 is controlled to move forward or backward by changing the Y-axis horizontal position of the motion sensing remote control device 100.

Another aspect of the present embodiment is that the calculation unit 20 generates the X-axis pulsed width modulation signal and/or the Y-axis pulsed width modulation signal, and the periodical variation for the X-axis pulsed width modulation signal and/or the Y-axis pulsed width modulation signal is thus obtained through the motion algorithm such that the remote control car 200 is controlled to adjust the turning scale and the proceeding speed. As for the present embodiment, when the X-axis pulsed width modulation signal becomes larger, the third motion message X" is set to the message for increasing the turning scale, and the motion setting unit 30 then decodes the third motion message X" into the third control command C3 so as to increase the turning scale for the remote control car 200.

In the present embodiment, the third control command C3 may include a command for increasing, fixing or decreasing the turning scale. Specifically, based on the X-axis pulsed width modulation signal, the third control command C3 determines which one of the above commands is used to generate the third control command C3. The user may preset the relation between the third motion message X" and the third control command C3 for the motion setting unit 30.

When the X-axis pulsed width modulation signal becomes smaller, the third motion message X" is set to the message for decreasing the turning scale. As long as the relation between the third motion message X" and the third control command C3 is preset in the motion setting database, the motion setting unit 30 can generate the third control command C3 for decreasing the turning scale such that the turning scale of the remote control car 200 is decreased.

With the above embodiment, the fourth control command may also refer to the period of the Y-axis pulsed width modulation signal so as to control the speed of the remote control car 200. For example, the speed of the remote control car 200 is controlled to increase as the period of the Y-axis pulsed width modulation signal becomes longer. On the contrary, the speed decreases when the period of the Y-axis pulsed width modulation signal becomes shorter, or the speed keeps constant if the period does not change.

For example, when the user wants to control the remote control car 200 to turn rightwise, the motion sensing remote control device 100 can be switched by a tilt angle in the rightwise and forward direction to cause the motion sensing module 10 to sense the physical variation of the angular velocity in X-axis and/or Y-axis so as to generate the analog voltage signal X for the angular velocity in X-axis and the analog voltage signal Y for the angular velocity in Y-axis, which are transferred to the motion setting unit 30 through the calculation unit 20. At the same time, the calculation unit 20 calculates the motion locus of the motion sensing remote control device 100 through the motion algorithm. In other words, the calculation unit 20 generates the first motion message X' for turning rightwise and the second motion message Y' for forward moving based on the variation of the analog voltage signals X and Y. Then, the motion setting unit 30 decodes the first motion message X' and the second motion message Y' to generate the first control command C1 for turning rightwise and the second control command C2 for forward moving such that the remote control car 200 performs the corresponding motion of turning rightwise and moving.

At this time, if the user wants to increase the turning scale for forward moving and turning rightwise, the calculation unit 20 may convert the analog voltage signal X for the angular velocity in X-axis and the analog voltage signal Y for the angular velocity in Y-axis into the X-axis pulsed width modulation signal and the Y-axis pulsed width modulation signal, which are transferred to the motion setting unit 30. The calculation unit 20 thus calculates the motion locus of the motion sensing remote control device 100 through the motion algorithm. That is, the calculation unit 20 generates the third motion message X" for increasing the turning scale and the fourth motion message Y" for speeding up according to the X-axis pulsed width modulation signal and the Y-axis pulsed width modulation signal. The motion setting unit 30 further decodes the third motion message X" and the fourth motion message Y" to generate the third control command C3 for increasing the turning scale and the fourth control command C4 for speeding up so as to cause the remote control car 200 to perform the specific proceeding effect of fast turning.

With the present invention, the problem of time lag for controlling the remote device by the user's hands in the prior arts, which is caused by triggering the control signal with the control bar, is successfully solved because the user can directly and intuitively control the motion sensing remote control device to make the remote control car to perform the corresponding motion as desired, thereby achieving the purpose of real time control.

Therefore, the user can use the gestures to manipulate the remote control car to perform any kind of motion with the help of the motion sensing module 10, which is synchronously activated with the motion sensing remote control device 100 to generate the signal as long as the angular velocity of the motion sensing remote control device 100 changes. Furthermore, the motion setting unit 30 and the related units automatically perform the function of transferring and controlling the signal such that the remote control car 200 can immediately respond and act. More specifically, the remote control car 200 seems to move synchronously with the user's gesture in the actual operation, and does not only improve the preciseness of remote control, but also enhance the sense of achievement and the fun for playing the remote control game.

Figure 2:
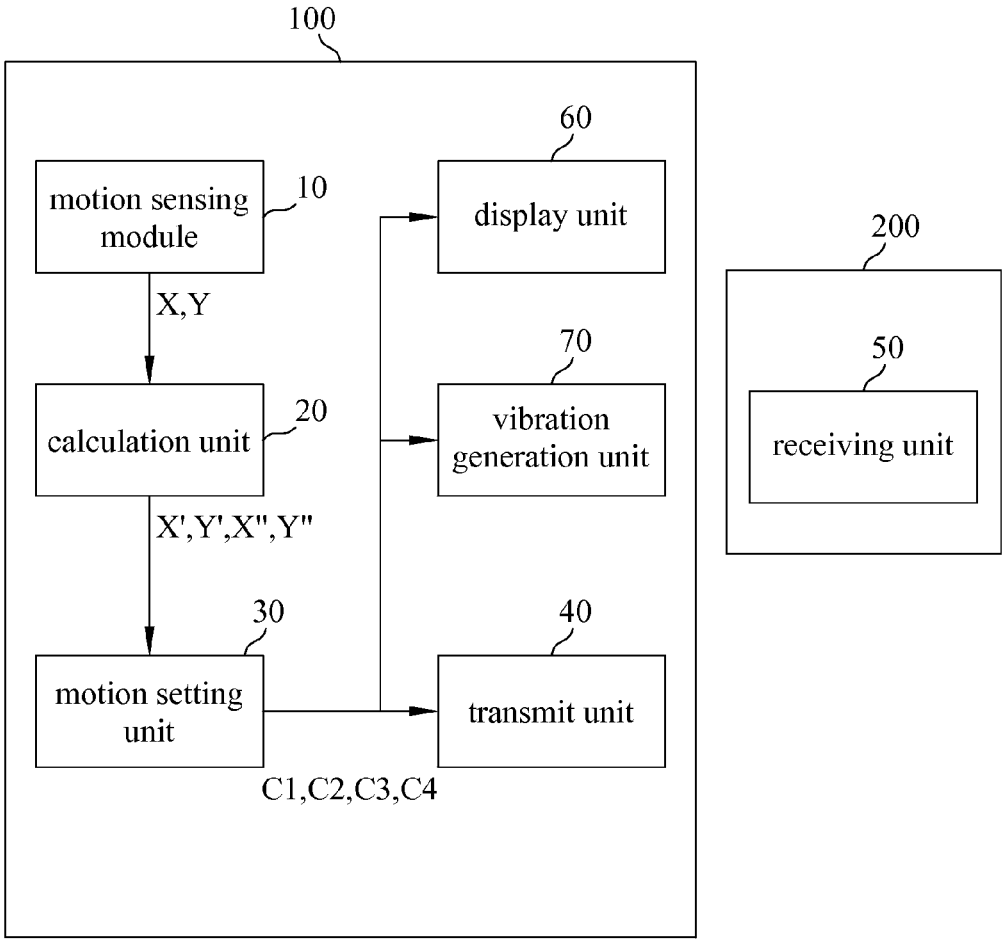
FIG. 2 is a functional block diagram of the motion sensing remote control device according to a second embodiment of the present invention.

Refer to FIG. 2 showing the functional block diagram of the motion sensing remote control device according to the second embodiment of the present invention. As shown in FIG. 2, the second embodiment of the present invention additionally comprises a display unit 60, which is provided in the motion sensing remote control device 100 and connected to the motion setting unit 30. The motion setting unit 30 further determines the offset direction for the X-axis angular displacement and/or the Y-axis angular displacement of the motion sensing remote control device 100 based on the analog voltage signal X for the angular velocity in X-axis and/or the analog voltage signal Y for the angular velocity in Y-axis. At the same time, a display command and/or a vibration command is generated and transmitted by the motion setting unit 30. The display command from the motion setting unit 30 is transferred to the display unit 60, which displays the corresponding music or generates the sound effect.

More specifically, the offset direction of the X-axis angular displacement of the motion sensing remote control device 100 at least comprises a clockwise or counter clockwise rotation in X-axis, and accordingly, the offset direction of the Y-axis angular displacement at least comprises a clockwise or counter clockwise rotation in Y-axis.

As for the present embodiment, if the motion sensing remote control device 100 rotates clockwise or counter clockwise in X-axis, the remote control car 200 turns right or left, and if the motion sensing remote control device 100 rotates clockwise or counter clockwise in Y-axis, the remote control car 200 moves backward or forward. The user can preset corresponding display commands for different offset directions such that the display unit performs different music or sound effect according to the display command.

With this, when the remote control car 200 turns left, the display unit 60 performs the music or sound effect corresponding to the motion of turning left. Similarly, when the remote control car 200 turns right, the display unit 60 performs the music or sound effect corresponding to the motion of turning right. Furthermore, after appropriate setting, the display unit 60 performs the music or sound effect corresponding to the motion of moving forward or backward when the remote control car 200 moves forward or backward.

As shown in FIG. 2, the present embodiment further comprises a vibration generation unit 70, which is provided in the motion sensing remote control device 100 and connected to the motion setting unit 30. The motion setting unit 30 transfers a vibration command to the vibration generation unit 70, which is caused to generate a vibration effect. For example, the vibration generation unit 70 is implemented by a vibration generation device.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A motion sensing remote control device for controlling a remote control car, comprising:

a motion sensing module provided on the motion sensing remote control device for sensing a respective physical variation of an angular velocity in X-axis and/or Y-axis, converting the physical variation into an analog voltage signal for the respective angular velocity in X-axis and/or Y-axis, and transmitting the analog voltage signal;

a calculation unit provided on the motion sensing remote control device and connected to the motion sensing module for receiving the analog voltage signal for the angular velocity in X-axis and/or Y-axis from the motion sensing remote control device, wherein the calculation unit calculates a variation of the analog voltage signal for the angular velocity in X-axis and/or Y-axis through a motion prediction algorithm, and encodes the variation into a first motion message and/or a second motion message, the first motion message comprises a message for turning right, left or back, the second motion message comprises a message for forward or backward moving or stopping movement, the calculation unit further converts the analog voltage signal for the angular velocity in X-axis and/or Y-axis into an X-axis pulsed width modulation signal and/or a Y-axis pulsed width modulation signal, calculates a periodical variation for the X-axis pulsed width modulation signal and/or the Y-axis pulsed width modulation signal through the motion prediction algorithm, and encodes a third motion message and/or a fourth motion message based on the periodical variation for the X-axis pulsed width modulation signal and/or the Y-axis pulsed width modulation signal, the third motion message comprises a message for increasing, fixing or reducing a turning scale, and the fourth motion message comprises a message for accelerating, fixing or decelerating movement;

a motion setting unit provided on the motion sensing remote control device and connected to the calculation unit for receiving the first, second, third and fourth motion messages from the calculation unit, wherein the motion setting unit decodes the first, second, third and fourth motion messages into first, second, third and fourth motion control commands, respectively, and transmits the first, second, third and fourth motion control commands, the motion setting unit comprises a built-in programmable and rewritable motion setting database, and the motion setting database comprises the first, second, third and fourth motion control commands corresponding to the first, second, third and fourth motion messages, respectively;

a transmit unit provided on the motion sensing remote control device and connected to the motion setting unit for receiving the first, second, third and/or fourth motion control commands from the motion setting unit, and wireless transmitting the first, second, third and/or fourth motion control commands; and a receiving unit provided in the remote control car for receiving the first, second, third and/or fourth motion control commands from the transmit unit, the first and second motion control commands used for the remote control car to steer a proceeding direction, and the third and fourth motion control commands used to change a turning scale and proceeding speed, wherein the first motion message is a message for turning right, left or back based on the variation of the analog voltage signal for the angular velocity in X-axis, the second motion message is a message for forward or backward moving, or stopping movement based on the variation of the analog voltage signal for the angular velocity in Y-axis, the third motion message is a message for increasing, fixing or reducing the turning scale based on the periodical variation of the analog voltage signal for the angular velocity in X-axis, and the fourth motion message is a message for accelerating, fixing or decelerating movement based on the periodical variation of the analog voltage signal for the angular velocity in Y-axis.

2. The motion sensing remote control device as claimed in claim 1, wherein the motion sensing module at least comprises an angular displacement sensor and a signal conversion circuit, the angular displacement sensor is used for sensing a physical variation for the angular velocity in X-axis and/or Y-axis of the motion sensing remote control device, and the signal conversion circuit is used for converting the physical variation for the angular velocity in X-axis and/or Y-axis into the analog voltage signal for the angular velocity in X-axis and/or Y-axis.

3. The motion sensing remote control device as claimed in claim 2, wherein the angular displacement sensor is an MEMS gyroscope, electronic compass or angular velocity meter.

4. The motion sensing remote control device as claimed in claim 1, wherein the receiving unit comprises a control chip connected to a motor driving device and a turning system of the remote control car, and the control chip controls the motor driving device to operate and the turning system to make a turn based on the first, second, third and fourth motion control commands.

5. The motion sensing remote control device as claimed in claim 1, wherein the motion setting unit further determines an offset direction for an X-axis angular displacement and/or a Y-axis angular displacement of the motion sensing remote control device based on the analog voltage signal for the angular velocity in X-axis and/or the analog voltage signal for the angular velocity in Y-axis, generates and transmits a display command and/or a vibration command.

6. The motion sensing remote control device as claimed in claim 5, further comprising a vibration generation unit provided in the motion sensing remote control device and connected to the motion setting unit for receiving the vibration command from the motion setting unit to generate a vibration effect.

7. The motion sensing remote control device as claimed in claim 1, wherein the transmit unit comprises a radio frequency transmit circuit, and the receiving unit comprises a radio frequency receive circuit.

* * * * *